US006789628B2

(12) United States Patent
Hess et al.

(10) Patent No.: US 6,789,628 B2
(45) Date of Patent: Sep. 14, 2004

(54) SYSTEMS AND METHODS FOR CONTROLLING FLOW AND ACCESS IN MULTILATERAL COMPLETIONS

(75) Inventors: Joe E. Hess, Anchorage, AK (US); Benji L. Smith, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 60 days.

(21) Appl. No.: 10/162,183

(22) Filed: Jun. 4, 2002

(65) Prior Publication Data

US 2003/0221834 A1 Dec. 4, 2003

(51) Int. Cl.[7] ..... E21B 43/12; E21B 43/14; E21B 23/00

(52) U.S. Cl. ..... 166/386; 166/311; 166/117.6; 166/242.3

(58) Field of Search ..... 166/313, 369, 166/373, 381, 386, 387, 52, 65.1, 66.6, 297, 55, 55.7, 117.5, 117.6, 242.1, 242.3

(56) References Cited

U.S. PATENT DOCUMENTS

| | | | | | |
|---|---|---|---|---|---|
| 4,807,704 | A | * | 2/1989 | Hsu et al. | 166/313 |
| 5,474,131 | A | * | 12/1995 | Jordan et al. | 166/313 |
| 5,613,559 | A | | 3/1997 | Williamson et al. | |
| 5,651,415 | A | | 7/1997 | Scales | |
| 5,715,891 | A | | 2/1998 | Graham | |
| 5,735,350 | A | * | 4/1998 | Longbottom et al. | 166/313 |
| 5,875,852 | A | | 3/1999 | Floyd et al. | |
| 5,884,704 | A | | 3/1999 | Longbottom et al. | |
| 5,918,669 | A | * | 7/1999 | Morris et al. | 166/50 |
| 5,957,207 | A | | 9/1999 | Schnatzmeyer | |
| 5,957,208 | A | | 9/1999 | Schnatzmeyer | |
| 5,964,287 | A | | 10/1999 | Brooks | |
| 5,979,558 | A | | 11/1999 | Bouldin et al. | |
| 5,992,525 | A | | 11/1999 | Williamson et al. | |
| 6,009,949 | A | * | 1/2000 | Gano et al. | 166/313 |
| 6,019,173 | A | * | 2/2000 | Saurer et al. | 166/98 |
| 6,079,494 | A | * | 6/2000 | Longbottom et al. | 166/313 |
| 6,125,937 | A | * | 10/2000 | Longbottom et al. | 166/313 |
| 6,192,988 | B1 | | 2/2001 | Tubel | |
| 6,209,648 | B1 | * | 4/2001 | Ohmer et al. | 166/313 |
| 6,311,776 | B1 | * | 11/2001 | Pringle et al. | 166/313 |
| 6,494,264 | B2 | * | 12/2002 | Pringle et al. | 166/313 |
| 6,543,541 | B2 | * | 4/2003 | Buyers et al. | 166/313 |
| 6,561,277 | B2 | * | 5/2003 | Algeroy et al. | 166/373 |
| 2002/0050358 | A1 | * | 5/2002 | Algeroy et al. | 166/313 |
| 2002/0104659 | A1 | * | 8/2002 | Buyers et al. | 166/313 |

FOREIGN PATENT DOCUMENTS

| | | | | |
|---|---|---|---|---|
| GB | 2342665 A | * | 4/2000 | E21B/34/10 |
| GB | 2359836 A | | 9/2001 | |
| GB | 2365047 A | | 2/2002 | |
| GB | 2367841 A | | 4/2002 | |

OTHER PUBLICATIONS

"SCRAMS Multi–Zone Completion", undated.
"Model HF Retrievable Production", undated.
"Interval Control Valve (ICV)", undated.
"AGIP Aquila SCRAMS Completion for Control of an . . . " undated.
"SAGA Snorre SCRAMS Two Zone Completion", undated.
"Petorbras Bonito Field ML Development", undated.
"Petrobras Subsea Taml #5 Injector", dated 2000.
Search Report for United Kingdom Application No.: 0312313.0.

* cited by examiner

*Primary Examiner*—David Bagnell
*Assistant Examiner*—Jennifer H Gay
(74) *Attorney, Agent, or Firm*—J. Richard Konneker; Marlin R. Smith

(57) ABSTRACT

Systems and methods for controlling flow and access in multilateral completions provide for controlling rates of flow from intersecting wellbores. Flow from a branch wellbore and flow from a lower parent wellbore are controlled by respective remotely actuated flow control devices interconnected in a production tubing string in the parent wellbore. Access is provided to both of the wellbores below an intersection of the wellbores.

56 Claims, 2 Drawing Sheets

SYSTEMS AND METHODS FOR CONTROLLING FLOW AND ACCESS IN MULTILATERAL COMPLETIONS

BACKGROUND

The present invention relates generally to operations performed and equipment utilized in conjunction with subterranean wells and, in an embodiment described herein, more particularly provides systems and methods for controlling flow and access in multilateral completions.

Multilateral wells typically have one or more branch or "lateral" wellbore branching off from a main or "parent" wellbore. An intersection between main and branch wellbores is known as a "wellbore junction." Completion equipment positioned at a wellbore junction for controlling access and/or flow between the wellbores may also be referred to as a "junction."

Various methods of completing wellbore junctions provide for access and/or flow between the wellbores, but do not include provisions for remotely varying the rate of fluid produced from each of the wellbores. Other methods of completing wellbore junctions provide for remotely varying the rate of fluid produced from each of the wellbores, but do not permit access between the wellbores. In some such completions, the entire completion string must be retrieved from the well in order to gain access to the branch wellbore, or to the main wellbore below the junction.

In view of the above, it will be readily appreciated that it would be highly desirable to provide a method wherein flow and access are permitted between main and branch wellbores, and wherein a rate of fluid produced from each of the wellbores may be remotely regulated. It would also be desirable to provide completion apparatus which permits remotely operated flow control devices thereof to be retrieved from the well separate from the remainder of the junction. It would further be desirable to otherwise provide improved systems and methods for controlling flow and access in multilateral completions.

SUMMARY

In carrying out the principles of the present invention, in accordance with particular embodiments thereof, systems and methods are provided for controlling flow and access in multilateral completions. These embodiments utilize multiple flow control devices to regulate flow between a tubular string and respective intersecting wellbores. The tubular string is engaged with a junction device, which provides separate passages for flow between the flow control devices and the respective wellbores.

In one aspect of the invention, a method of controlling flow in a well having intersecting first and second wellbores is provided. The method includes the steps of positioning a junction device in the well, the junction device having first and second flow passages formed therethrough, and engaging a tubular string with the junction device. The first flow passage communicates with an interior of the tubular string, and the second flow passage communicates with an annulus formed between the tubular string and the first wellbore, when the engaged tubular string and junction device are positioned in the well.

Fluid produced into the first wellbore through the first flow passage is flowed to an exterior of the tubular string, and then into the tubular string via a first flow control device. Fluid produced into the second wellbore is flowed through the second flow passage, then into the annulus, and then into the tubular string via a second flow control device.

In another aspect of the invention, another method of controlling flow in a well having intersecting first and second wellbores is provided. The method includes the steps of positioning a junction device in the well, the junction device having first and second flow passages formed therein, and engaging a tubular string with the junction device, the tubular string having a first flow control device interconnected therein operative to regulate flow between the first flow passage and an interior of the tubular string, and the tubular string having a second flow control device interconnected therein operative to regulate flow between the second flow passage and the tubular string interior. Fluid flowing between an interior of the tubular string and the first flow passage is isolated, external to the tubular string, from fluid flowing between the interior of the tubular string and the second flow passage.

In yet another aspect of the invention, a system for controlling flow in a well having an intersection between first and second wellbores is provided. The system includes a tubular string positioned in the first wellbore, the tubular string having first and second flow control devices interconnected therein. A junction device is engaged with the tubular string and has first and second flow passages therein.

The first flow passage provides fluid communication between the first flow control device and the first wellbore below the intersection. The second flow passage provides fluid communication between the second flow control device and the second wellbore below the intersection. A window is formed in the junction device, thereby providing access between the first and second flow passages.

In a further aspect of the invention, another system for controlling flow in a well having an intersection between first and second wellbores is provided. The system includes a junction device having first and second flow passages formed therein, the first flow passage being in fluid communication with the first wellbore below the intersection, and the second flow passage being in fluid communication with the second wellbore below the intersection. A tubular string has first and second flow control devices interconnected therein. The first flow control device regulates flow between the first flow passage and an interior of the tubular string. The second flow control device regulates flow between the second flow passage and the tubular string interior.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
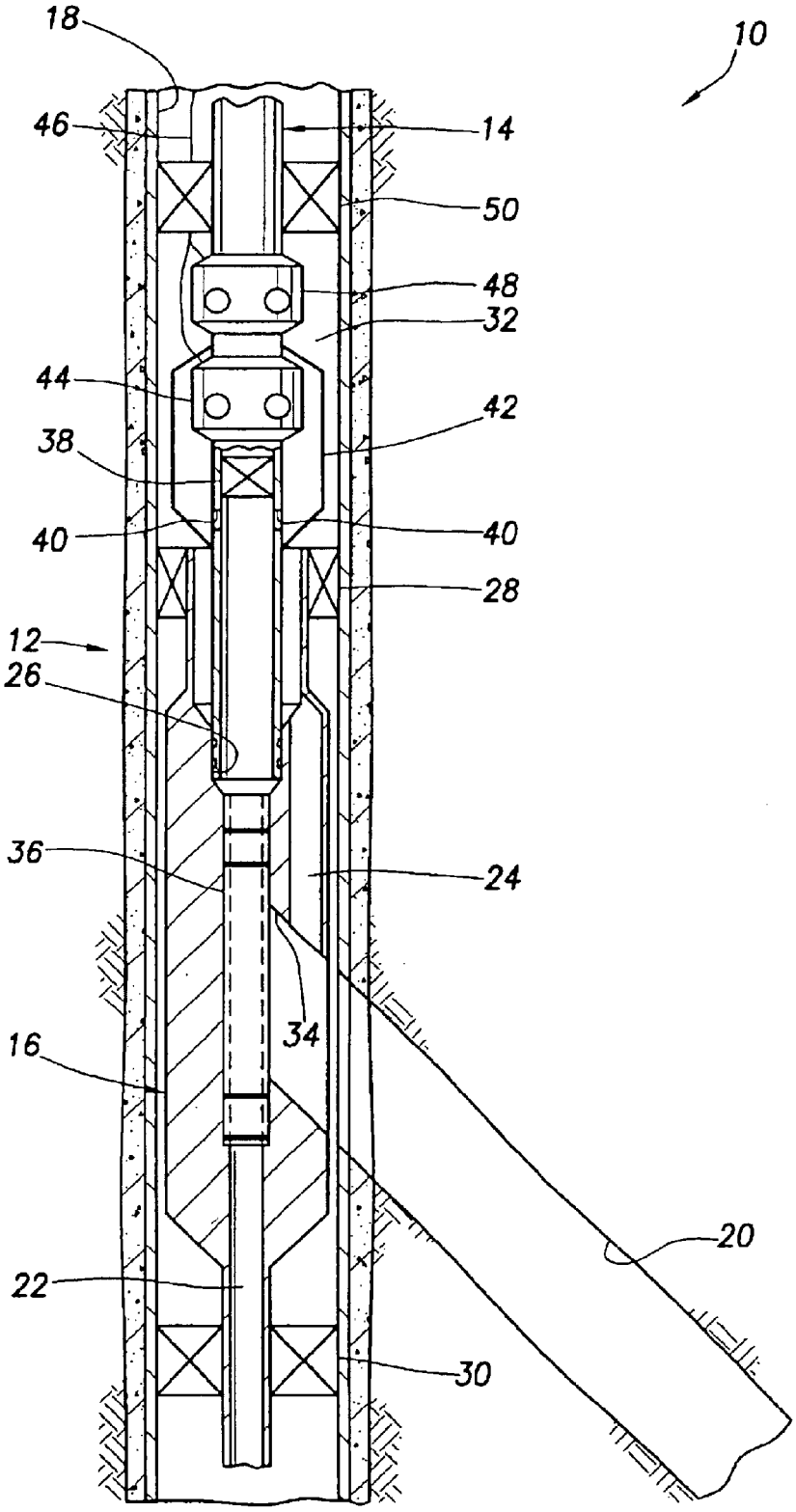
FIG. 1 is a cross-sectional view of a first method and apparatus embodying principles of the present invention.

Representatively illustrated in FIG. 1 is a method 10 which embodies principles of the present invention. In the following description of the method 10 and other systems and methods described herein, directional terms, such as "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

The method 10 utilizes a completion system 12 which includes a tubular string 14 engaged with a junction device 16 in a well. Preferably, the junction device 16 is positioned at an intersection between a parent wellbore 18 and a branch wellbore 20 prior to conveying the tubular string 14 into the well, but the junction device and tubular string could be conveyed into the well together, if desired. A lower end of the tubular string 14 is releasably sealingly received in a seal bore 26 formed in the junction device 16.

As depicted in FIG. 1, the parent wellbore 18 is cased both above and below its intersection with the branch wellbore 20. The branch wellbore 20 is depicted as being unlined. However, none, all or any portions of the parent and branch wellbores 18, 20 may be cased or lined in keeping with the principles of the invention.

The junction device 16 is secured in the parent wellbore 18 by packers or other anchoring devices 28, 30 above and below the junction device, respectively. As used herein, the term "above" means in a direction toward the earth's surface along a wellbore, and the term "below" means in a direction away from the earth's surface along a wellbore, regardless of actual depth beneath the earth's surface. Note that the packers 28, 30 seal between the junction device 16 and the parent wellbore 18 above and below the intersection between the wellbores 18, 20, respectively.

The junction device 16 has flow passages 22, 24 formed therein. The flow passage 22 communicates with the parent wellbore 18 below the lower packer 30. The flow passage 24 communicates with the branch wellbore 20. In a producing well, fluid produced into the parent wellbore 18 below the lower packer 30 will flow into the passage 22 and upward into the lower end of the tubular string 14. Fluid produced into the branch wellbore 20 will flow into the passage 24 and upward into an annulus 32 between the tubular string 14 and the parent wellbore 18. Of course, if the well is an injection well, these flow directions would be reversed. For convenience, the remainder of this detailed description will be given as if the well is a producing well, but it is to be understood that the principles of the invention may be applied to injection wells, also.

The junction device 16 has a window or other opening 34 formed therein between the first and second flow passages 22, 24. The window 34 permits access between the first and second passages 22, 24 when it is desired to convey equipment, such as logging tools, screens, perforating guns, tubing strings, various items of stimulation and completion equipment, etc. into the branch wellbore 20. During normal production operations, however, the window 34 is blocked by a sleeve or other closure member 36 sealingly received in the junction device 16.

The sleeve 36 isolates fluid in the passage 22 from fluid in the passage 24 by preventing fluid flow through the window 34. The passage 22 extends through an interior of the sleeve 36. Other types of closure members may be utilized without departing from the principles of the invention, for example, a closure member which rotates within the junction device 16 rather than displacing axially within the junction device.

Preferably, the sleeve 36 is retrievable from the well through the interior of the tubular string 14. Thus, it is not necessary for the tubular string 14 to be retrieved from the well in order to provide access to the branch wellbore 20. After such access is no longer needed, or it is otherwise desired to isolate the flow passages 22, 24 from each other, the sleeve 36 may be installed in the junction device 16 by conveying it through the tubular string 14.

As described above, fluid flowed into the passage 22 from the parent wellbore 18 below the lower packer 30 then flows through the sleeve 36 and into the interior of the tubular string 14. A retrievable plug 38 isolates a lower portion of the tubular string interior from an upper portion. However, openings 40 formed through a sidewall of the tubular string 14 permit the fluid to flow out of the tubular string 14 and into the interior of an enclosure, housing or shroud 42 outwardly surrounding the openings and a flow control device 44 interconnected in the tubular string.

The enclosure 42 isolates the fluid flowing therein from fluid in the annulus 32. The flow control device 44 regulates the flow of fluid from the interior of the enclosure 42 to the interior of the tubular string 14. Preferably, the flow control device 44 is a remotely actuatable choke. Electrical, hydraulic and/or fiber optic lines 46 extend to a remote location, such as the earth's surface or another position in the well, for transmitting signals and/or power to actuate the flow control device 44. Other means of actuating the flow control device 44, such as via acoustic or electromagnetic telemetry, may be used in keeping with the principles of the invention.

Preferably, the flow control device 44 has a relatively large internal bore therethrough, so that the plug 38 and/or sleeve 36 may be retrieved and installed through the flow control device. However, such an internal bore through the flow control device 44 is not necessary. One acceptable remotely actuatable choke which may be used for the flow control device 44 is the Interval Control Valve available from WellDynamics, Inc. of Houston, Tex.

Another flow control device 48 regulates the flow of fluid from the annulus 32 to the interior of the tubular string 14. The flow control device 48 may be similar or identical to the flow control device 44 described above, or it may be different. Preferably, the flow control device 48 is a remotely actuatable choke controlled via the lines 46, similar to the flow control device 44.

If the tubular string 14 is conveyed into the well after the junction device 16 is positioned at the wellbore intersection, then the lower end of the tubular string is sealingly received in the seal bore 26 of the junction device. An upper packer or other anchoring device 50 interconnected in the tubular string 14 is then set in the parent wellbore 18 above the upper flow control device 48. In this manner, the tubular string 14 is secured in engagement with the junction device 16, and the annulus 32 between the packers 30, 50 is isolated from other portions of the parent wellbore 18.

It will be readily appreciated by one skilled in the art that the method 10 and system 12 provide substantial benefits in multilateral completions. The flow control devices 44, 48 permit independent remote control of the respective rates of flow from the parent wellbore 18 below the lower packer 30 and from the branch wellbore 20. If the flow control devices 44, 48 require maintenance, or if for any other reason it is desired to pull the tubular string 14 from the well, the flow control devices and associated lines 46 may be conveniently retrieved together, rather than having to disconnect and later reconnect lines in the well if the flow control devices were not retrieved with the tubular string. However, the flow control devices 44, 48 could be retrieved from the well separate from the remainder of the tubular string 14 without departing from the principles of the invention.

The plug 38 and the sleeve 36 may be conveniently retrieved from the well through the tubular string 14. Thus, it is not necessary for the tubular string 14 to be pulled from the well in order to provide access to the branch wellbore 20. When such access is no longer needed, the sleeve 36 and plug 38 may be reinstalled through the tubular string 14 to again isolate the flow passages 22, 24 from each other. However, it should be understood that retrieval or installation of the plug 38 and/or sleeve 36 through the tubular string 14 is not necessary in keeping with the principles of the invention.

Figure 2:
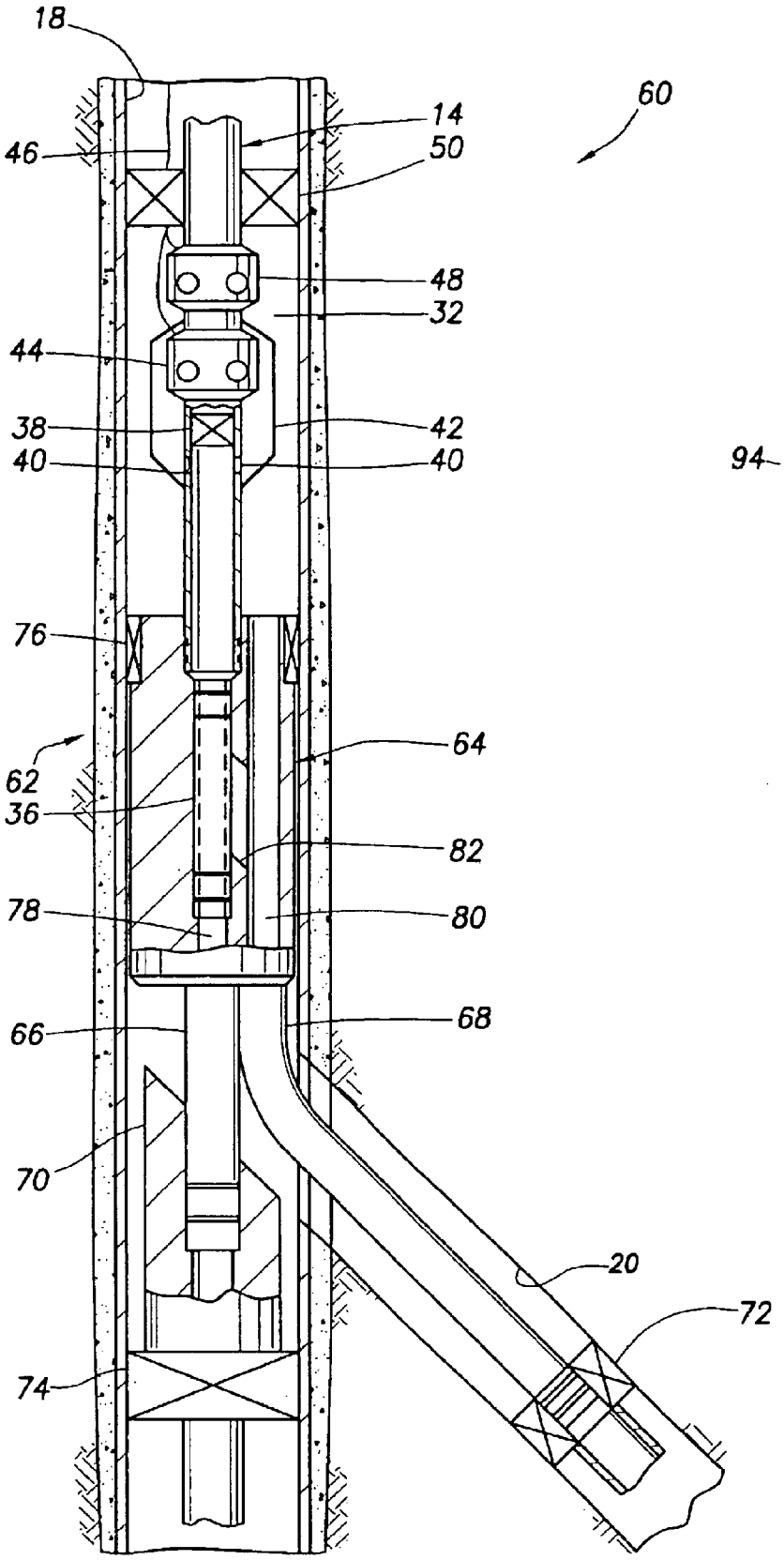
FIG. 2 is a cross-sectional view of a second method and apparatus embodying principles of the present invention.

Referring additionally now to FIG. 2, another method 60 embodying principles of the invention is representatively illustrated. The method 60 is similar in many respects to the method 10 described above. For convenience, elements of the method 60 which are similar to those described above for the method 10 are indicated in FIG. 2 using the same reference numbers.

The method 60 differs from the method 10 in substantial part in that a completion system 62 is utilized which includes a junction device 64 having individual tubing strings or other conduits 66, 68 connected at a lower end thereof. When the junction device 64 is conveyed into the well, the tubing string 68 (which is preferably, although not necessarily, longer than the tubing string 66) is deflected by a whipstock or other deflector 70 into the branch wellbore 20. The lower end of the tubing string 68 is eventually sealingly received in a seal bore of a packer 72 set in the branch wellbore 20. The lower end of the tubing string 66 is received in a seal bore of the deflector 70.

The packer 72 isolates the branch wellbore 20 below the packer from the intersection of the wellbores 18, 20. Another packer 74 attached to the deflector 70 isolates the wellbore intersection from the parent wellbore 18 below the packer. Yet another packer 76 attached to the junction device 64 isolates the wellbore junction from the parent wellbore 18 above the packer.

Thus, the multilateral completion achieved by the method 60 is of the type known to those skilled in the art as a "level 5" completion. The method 10 described above achieves a multilateral completion of the type known as a "level 4" completion, since the wellbore intersection is not isolated from the branch wellbore 20 below the intersection. Any level of multilateral completion, such as a level 3 or a level 6 completion, may be achieved in keeping with the principles of the invention.

The tubing string 66 provides a conduit for flow of fluid from the parent wellbore 18 below the packer 74 to a flow passage 78 formed in the junction device 64. The tubing string 68 provides a conduit for flow of fluid from the branch wellbore 20 below the packer 72 to a flow passage 80 formed in the junction device 64. A window 82 is formed in the junction device 64 between the passages 78, 80.

The window 82 is normally blocked by the sleeve 36, thereby preventing access and fluid flow between the passages 78, 80. However, when the sleeve 36 is retrieved from the junction device 64, equipment may be conveyed through the tubular string 14, into the passage 78, deflected through the window 82 into the passage 80, into the tubing string 68, and into the branch wellbore 20. This may be conveniently accomplished without pulling the tubular string 14 from the well.

The passage 78 communicates with the interior of the tubular string 14, similar to the manner in which the passage 22 communicates with the interior of the tubular string in the method 10. Fluid flows from the passage 78 to the interior of the tubular string, out through the openings 40 into the interior of the enclosure 42, and then into the tubular string via the flow control device 44.

The passage 80 communicates with the annulus 32 above the packer 76. Fluid flows from the passage 80 to the annulus 32, and then into the tubular string via the flow control device 48. Note that the enclosure 42 isolates fluid in the annulus 32 from fluid in the interior of the enclosure, thereby permitting flow of these respective fluids to be independently regulated by the flow control devices 44, 48.

Figure 3:
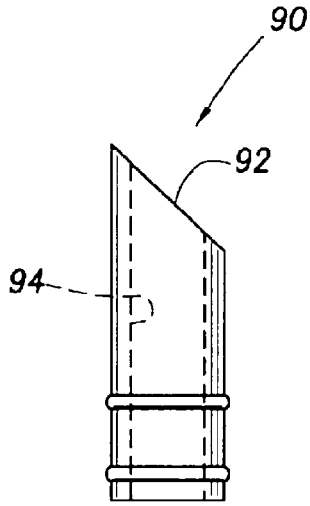
FIG. 3 is a side elevational view of a deflector which may be used in the first and second methods.

Referring additionally now to FIG. 3, a deflector go is representatively illustrated. The deflector go may be used in the methods 10, 60 when it is desired to deflect equipment through the respective windows 34, 82. Specifically, the sleeve 36 may be retrieved from the junction device 16 or 64, and replaced with the deflector 90. As with the sleeve 36, the deflector go is preferably retrievable and installable through the tubular string 14.

The deflector 90 includes an upper inclined surface 92 for laterally deflecting equipment which contacts the surface. The deflector 90 may also include an internal passage 94, so that the junction device passages 22, 78 may extend therethrough when the deflector is installed in the respective junction devices 16, 64. The deflector passage 94 may be dimensioned so that larger equipment is deflected off of the surface 92, while smaller equipment is permitted to pass through the passage, thereby enabling equipment to be selectively conveyed into the branch wellbore 20, or into the parent wellbore 18 below the junction device as desired.

Thus have been described the methods 10, 60 and completion systems 12, 62 which provide improved control of access and flow in multilateral completions. The methods 10, 60 and systems 12, 62 permit independent control of flow from each of intersecting wellbores 18, 20 using remotely actuatable flow control devices 44, 48, which may be retrieved from the well with the tubular string 14 without also retrieving the junction devices 16, 64. Access to the branch wellbore 20 and to the parent wellbore 18 below the wellbore intersection may be conveniently obtained without retrieving the tubular string 14 from the well.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of controlling flow in a well having intersecting first and second wellbores, the method comprising the steps of:

positioning a junction device in the well, the junction device having first and second separate flow passages formed therethrough;

engaging a tubular string with the junction device, so that the first flow passage communicates with an interior of the tubular string, and the second flow passage communicates with an annulus formed between the tubular string and the first wellbore, when the engaged tubular string and junction device are positioned in the well;

flowing fluid produced into the first wellbore through the first flow passage to an exterior of the tubular string, and then into the tubular string via a first flow control device;

flowing fluid produced into the second wellbore through the second flow passage, then into the annulus, and then into the tubular string via a second flow control device; and providing access between the first and second flow passages within the junction device via a window formed within the junction device between the first and second separate flow passages.

2. The method according to claim 1, further comprising the step of blocking access through the window by displacing a closure member in the junction device.

3. The method according to claim 2, wherein the displacing step is performed by installing the closure member into the junction device while the junction device is positioned in the well.

4. The method according to claim 2, wherein the access blocking step further comprises preventing fluid flow through the window between the first and second flow passages.

5. The method according to claim 1, wherein in the step of flowing fluid produced into the first wellbore, the fluid is flowed out of the tubular string into an interior of an enclosure isolated from the annulus, and then the fluid is flowed from the interior of the enclosure and through the first flow control device into the tubular string.

6. The method according to claim 1, wherein in the step of flowing fluid produced into the second wellbore, a tubing string is interconnected between the junction device and a sealing device in the second wellbore, the tubing string providing a conduit for flow between the second flow passage and the second wellbore below the sealing device.

7. The method according to claim 1, wherein the step of flowing fluid produced into the first wellbore further comprises remotely actuating the first flow control device to regulate flow therethrough.

8. The method according to claim 1, wherein the step of flowing fluid produced into the second wellbore further comprises remotely actuating the second flow control device to regulate flow therethrough.

9. The method according to claim 1, wherein in the steps of flowing fluid produced into the first and second wellbores, the first and second flow control devices are each remotely actuated to regulate flow therethrough.

10. The method according to claim 1, wherein in the step of flowing fluid produced into the first wellbore, a tubing string is interconnected between the junction device and a sealing device in the first wellbore, the tubing string providing a conduit for flow between the first flow passage and the first wellbore below the sealing device.

11. A method of controlling flow in a well having intersecting first and second wellbores, the method comprising the steps of:

positioning a junction device in the well, the junction device having first and second flow passages formed therethrough;

engaging a tubular string with the junction device, so that the first flow passage communicates with an interior of the tubular string, and the second flow passage communicates with an annulus formed between the tubular string and the first wellbore, when the engaged tubular string and junction device are positioned in the well;

flowing fluid produced into the first wellbore through the first flow passage to an exterior of the tubular string, and then into the tubular string via a first flow control device; and flowing fluid produced into the second wellbore through the second flow passage, then into the annulus, and then into the tubular string via a second flow control device, the engaging step further comprising sealingly engaging the tubular string with the junction device after the positioning step.

12. A method of controlling flow in a well having intersecting first and second wellbores, the method comprising the steps of:

positioning a junction device in the well, the junction device having first and second flow passages formed therethrough;

engaging a tubular string with the junction device, so that the first flow passage communicates with an interior of the tubular string, and the second flow passage communicates with an annulus formed between the tubular string and the first wellbore, when the engaged tubular string and junction device are positioned in the well;

flowing fluid produced into the first wellbore through the first flow passage to an exterior of the tubular string, and then into the tubular string via a first flow control device;

flowing fluid produced into the second wellbore through the second flow passage, then into the annulus, and then into the tubular string via a second flow control device the engaging step further comprises sealingly engaging the tubular string with the junction device after the positioning step; and disengaging the tubular string from the junction device and retrieving the first and second flow control devices with the tubular string from the well separate from the junction device.

13. A method of controlling flow in a well having intersecting first and second wellbores, the method comprising the steps of:

positioning a junction device in the well, the junction device having first and second separate flow passages formed therethrough;

engaging a tubular string with the junction device, so that the first flow passage communicates with an interior of the tubular string, and the second flow passage communicates with an annulus formed between the tubular string and the first wellbore, when the engaged tubular string and junction device are positioned in the well;

flowing fluid produced into the first wellbore through the first flow passage to an exterior of the tubular string, and then into the tubular string via a first flow control device;

flowing fluid produced into the second wellbore through the second flow passage, then into the annulus, and then into the tubular string via a second flow control device, the engaging step further comprising sealingly engaging the tubular string with the junction device after the positioning step; and installing a deflector in the junction device to thereby deflect equipment from the first separate flow passage into the second separate flow passage via a window formed therebetween.

14. A method of controlling flow in a well having intersecting first and second wellbores, the method comprising the steps of:

positioning a junction device in the well, the junction device having first and second separate flow passages formed therein;

engaging a tubular string with the junction device, the tubular string having a first flow control device interconnected therein operative to regulate flow between the first flow passage and an interior of the tubular string, and the tubular string having a second flow control device interconnected therein operative to regulate flow between the second flow passage and the tubular string interior;

isolating, external to the tubular string, fluid flowing between an interior of the tubular string and the first flow passage from fluid flowing between the interior of the tubular string and the second flow passage; and providing access between the first and second separate flow passages within the junction device via a window formed between the first and second separate flow passages.

15. The method according to claim 14, further comprising the step of blocking access through the window by displacing a closure member in the junction device.

16. The method according to claim 15, wherein the displacing step is performed by installing the closure member into the junction device while the junction device is positioned in the well.

17. The method according to claim 15, wherein the access blocking step further comprises preventing fluid flow through the window between the first and second flow passages.

18. The method according to claim 14, wherein the isolating step further comprises flowing fluid through the first flow control device between an interior of an enclosure and the interior of the tubular string, the enclosure interior being isolated from an annulus between the tubular string and the first wellbore, and the enclosure interior being in fluid communication with the first flow passage.

19. The method according to claim 18, wherein the isolating step further comprises providing fluid communication between the second flow passage and the annulus.

20. The method according to claim 14, further comprising the step of interconnecting a tubing string between the junction device and a sealing device in the second wellbore, the tubing string providing a conduit for flow between the second flow passage and the second wellbore below the sealing device.

21. The method according to claim 14, further comprising the step of remotely actuating the first flow control device to regulate flow therethrough.

22. The method according to claim 14, further comprising the step of remotely actuating the second flow control device to regulate flow therethrough.

23. The method according to claim 14, wherein in the engaging step, each of the first and second flow control devices is remotely actuated.

24. The method according to claim 14, further comprising the step of interconnecting a tubing string between the junction device and a sealing device in the first wellbore, the tubing string providing a conduit for flow between the first flow passage and the first wellbore below the sealing device.

25. A method of controlling flow in a well having intersecting first and second wellbores, the method comprising the steps of:

positioning a junction device in the well, the junction device having first and second flow passages formed therein;

engaging a tubular string with the junction device, the tubular string having a first flow control device interconnected therein operative to regulate flow between the first flow passage and an interior of the tubular string, and the tubular string having a second flow control device interconnected therein operative to regulate flow between the second flow passage and the tubular string interior; and isolating, external to the tubular string, fluid flowing between an interior of the tubular string and the first flow passage from fluid flowing between the interior of the tubular string and the second flow passage, the engaging step further comprising sealingly engaging the tubular string with the junction device after the positioning step.

26. A method of controlling flow in a well having intersecting first and second wellbores, the method comprising the steps of:

positioning a junction device in the well, the junction device having first and second flow passages formed therein;

engaging a tubular string with the junction device, the tubular string having a first flow control device interconnected therein operative to regulate flow between the first flow passage and an interior of the tubular string, and the tubular string having a second flow control device interconnected therein operative to regulate flow between the second flow passage and the tubular string interior;

isolating, external to the tubular string, fluid flowing between an interior of the tubular string and the first flow passage from fluid flowing between the interior Of the tubular string and the second flow passage; and disengaging the tubular string from the junction device and retrieving the first and second flow control devices with the tubular string from the well separate from the junction device.

27. A method of controlling flow in a well having intersecting first and second wellbores, the method comprising the steps of:

positioning a junction device in the well, the junction device having first and second separate flow passages formed therein and communicated by a window extending therebetween;

engaging a tubular string with the junction device, the tubular string having a first flow control device interconnected therein operative to regulate flow between the first flow passage and an interior of the tubular string, and the tubular string having a second flow control device interconnected therein operative to regulate flow between the second flow passage and the tubular string interior;

isolating, external to the tubular string, fluid flowing between an interior of the tubular string and the first flow passage from fluid flowing between the interior of the tubular string and the second flow passage; and installing a deflector in the junction device to thereby deflect equipment from the first flow passage into the second flow passage via the window.

28. A system for controlling flow in a well having an intersection between first and second wellbores, the system comprising:

a tubular string positioned in the first wellbore, the tubular string having first and second flow control devices interconnected therein; and a junction device engaged with the tubular string and having first and second separate flow passages therein, the first flow passage providing fluid communication between the first flow control device and the first wellbore below the intersection, the second flow passage providing fluid communication between the second flow control device and the second wellbore below the intersection, and wherein a window formed in the junction device provides access between the first and second separate flow passages.

29. The system according to claim 28, wherein each of the first and second flow control devices regulates flow between an interior and an exterior of the tubular string.

30. The system according to claim 28, wherein the first flow control device regulates flow between an interior of the tubular string and an interior of an enclosure external to the tubular string.

31. The system according to claim 30, wherein the interior of the enclosure is isolated from an annulus between the tubular string and the first wellbore.

32. The system according to claim 31, wherein fluid flows in the annulus between the second flow passage and the second flow control device.

33. The system according to claim 30, wherein the enclosure externally surrounds the first flow control device.

34. The system according to claim 28, wherein each of the first and second flow control devices is remotely actuated.

35. The system according to claim 28, wherein the tubular string is releasably sealingly engaged with the junction device, the first flow passage being in fluid communication with an interior of the tubular string.

36. The system according to claim 35, wherein the second flow passage is in fluid communication with an annulus between the tubular string and the first wellbore.

37. The system according to claim 36, wherein the first flow passage is isolated from the annulus.

38. The system according to claim 28, wherein the tubular string is retrievable from the well separate from the junction device.

39. The system according to claim 28, further comprising a closure member blocking access through the window between the first and second flow passages.

40. The system according to claim 39, wherein the closure member is sealed within the junction device so that fluid flow through the window between the first and second flow passages is prevented.

41. A system for controlling flow in a well having an intersection between first and second wellbores, the system comprising:

a junction device having first and second separate flow passages formed therein, the first flow passage being in fluid communication with the first wellbore below the intersection, and the second flow passage being in fluid communication with the second wellbore below the intersection, the junction device including a window formed between the first and second separate flow passages; and a tubular string having first and second flow control devices interconnected therein, the first flow control device regulating flow between the first flow passage and an interior of the tubular string, and the second flow control device regulating flow between the second flow passage and the tubular string interior.

42. The system according to claim 41, wherein fluid flowing between the first flow passage and the tubular string interior is isolated, external to the tubular string, from fluid flowing between the second flow passage and the tubular string interior.

43. The system according to claim 41, further comprising a deflector installed in the junction device, the deflector deflecting equipment through the window between the first and second flow passages.

44. The system according to claim 43, wherein the deflector is retrievable from the well through the tubular string.

45. The system according to claim 41, further comprising a closure member blocking access through the window between the first and second flow passages.

46. The system according to claim 45, wherein the closure member is retrievable from the well through the tubular string.

47. The system according to claim 45, wherein the closure member further prevents fluid flow through the window between the first and second flow passages.

48. The system according to claim 41, further comprising an enclosure having an interior in direct communication with an exterior of the first flow control device, the interior of the enclosure being in communication with the first flow passage, and the first flow control device regulating flow between the interior of the enclosure and the tubular string interior.

49. The system according to claim 48, wherein the enclosure interior is isolated from an annulus between the tubular string and the first wellbore.

50. The system according to claim 49, wherein fluid flows in the annulus between the second flow passage and the second flow control device.

51. The system according to claim 41, wherein each of the first and second flow control devices is actuated to regulate flow therethrough from a remote location.

52. A system for controlling flow in a well having an intersection between first and second wellbores, the system comprising:

a junction device having first and second flow passages formed therein, the first flow passage being in fluid communication with the first wellbore below the intersection, and the second flow passage being in fluid communication with the second wellbore below the intersection; and a tubular string having first and second flow control devices interconnected therein, the first flow control device regulating flow between the first flow passage and an interior of the tubular string, and the second flow control device regulating flow between the second flow passage and the tubular string interior, the tubular string being releasably sealingly engaged with the junction device, the tubular string being retrievable from the well separate from the junction device.

53. The system according to claim 52, wherein the first flow passage is placed in direct fluid communication with a first portion of the tubular string interior when the tubular string is engaged with the junction device.

54. The system according to claim 53, wherein each of the first and second flow control devices regulates fluid flow between a respective one of the first and second flow passages and a second portion of the tubular string interior.

55. The system according to claim 54, wherein the tubular string interior first portion is isolated from the tubular string interior second portion by a plug positioned in the tubular string interior.

56. The system according to claim 55, wherein the plug is retrievable from the well through the tubular string.

* * * * *